United States Patent [19]

Bucherre

[11] Patent Number: 4,527,927

[45] Date of Patent: Jul. 9, 1985

[54] WATER HARVESTING AND STORAGE SYSTEM

[76] Inventor: Veronique Bucherre, 4707 Connecticut Ave., NW., Washington, D.C. 20008

[21] Appl. No.: 595,872

[22] Filed: Apr. 2, 1984

[51] Int. Cl.[3] ..... B65G 5/00; E02B 13/00

[52] U.S. Cl. ..... 405/53; 405/36; 405/52

[58] Field of Search ..... 405/36, 38, 39, 52, 405/53, 55, 270

[56] References Cited

U.S. PATENT DOCUMENTS

| | | | |
|---|---|---|---|
| 3,501,917 | 3/1970 | Detter | 405/53 |
| 3,517,513 | 6/1970 | Renshaw et al. | 405/52 |
| 4,335,977 | 6/1982 | Ihli | 405/52 |
| 4,457,646 | 7/1984 | Laesch | 405/52 |

*Primary Examiner*—David H. Corbin

*Attorney, Agent, or Firm*—Pollock, Vande Sande & Priddy

[57] ABSTRACT

An inexpensive and easily constructed arrangement for the supply of potable water includes a sheet or membrane for a catchment, one or more flexible closed storage tanks for water storage purposes, a strainer for location and piping between the catchment and storage tanks, one or more pumps and additional piping between the storage tanks and the pump or pumps. Installation is relatively simple only requiring an excavation for the location of the storage tanks, preparation of a suitable region for location of the catchment, securing the sheet or membrane over the prepared catchment surface and connection of the piping between the catchment, storage tanks(s) and pump(s).

7 Claims, 6 Drawing Figures

WATER HARVESTING AND STORAGE SYSTEM

DESCRIPTION

1. Technical Field

The invention provides for the collection and storage of rainwater that will subsequently be used for human consumption, livestock, domestic use and/or irrigation.

2. Background Art

In the United States, as in other parts of the world, sufficient water is not only needed for domestic uses and industrial and agricultural activities on a daily basis, it is a vital element of daily life. Man has not found a substitute for water and his dependence is real and so far unavoidable. However, reasonable access to safe potable water is still lacking for the majority of the world population. Insufficient water means great effort and time consuming search for those who need it; health and sanitation problems; economic difficulties and, in a number of areas, progressive desertification of the land.

Harvesting rainwater is a procedure that has been in application for centuries where and when other sources of water were either inadequate or insufficient.

In agriculture, natural slopes were modified to allow larger quantities of water to flow downstream to the lower fields, or to channel the collected water into livestock metal or concrete drinking troughs. Another possibility has been to collect rainwater from individual house-roofs.

Because they lack adequate storage designed to provide sufficient amounts of safe and clean water (potable) for long periods of time, these procedures could only be considered as an additional source of water on a temporary basis. Typical of the prior art is McGrew, et al., U.S. Pat. No. 3,331,207; Schneider, U.S. Pat. No. 4,092,827; Willis, U.S. Pat. No. 4,326,818; Ihli, U.S. Pat. No. 4,335,977; and Brady, et al., U.S. Pat. No. 4,405,264. Of these patents, the Schneider, Willis and Ihli systems, while they may be quite acceptable for their particular applications, they require construction efforts and techniques which make them simply unsuitable for undeveloped countries. Underdeveloped countries typically require inexpensive solutions requiring little or no technical skill for implementation. Even in developed countries, the solutions are not suitable for potable water needs which may be marginal and thus do not justify the expenditure of resources necessary for construction of the devices shown in these patents. The arrangement shown in the Brady, et al., patent requires, in effect, the in situ manufacture of suitable water impervious cloths or sheets. If the materials required for this fabrication are inexpensive enough the invention may be suitable for use in developed countries. On the other hand, regardless of the cost, the technical skill required for implementing the Brady, et al., invention may require skills beyond those available in undeveloped countries. Another drawback of the Brady, et al., solution is the unprotected nature of both the catchment plane 31 and the reservoir 42. Thus, it is questionable whether water collected and stored in accordance with the Brady, et al., technique would be clean and safe, e.g., potable. Finally the McGrew, et al., system is only usable for distribution, e.g., it depends on "withdrawing water from a stream or other source of supply in a water shed, such as natural or artificial ponds, lakes, springs and the like, from which water flows throughout at least a substantial portion of the year". In many areas, if this requirement were met, there would be no reason for application of the present invention.

The purpose of this system is to offer a possibility to provide clean and safe water, efficiently, at low cost, under various and even adverse climatic conditions while respecting local traditions and customs as well as the environment. Accordingly, it is a purpose of this invention to provide safe water to as many people as possible in quantities unattainable under normal natural conditions.

Another purpose of this invention is to provide safe water to as many people as possible and reduce the presence of water borne and/or water related diseases where this system will be installed.

Yet another purpose of this invention is to provide safe water to as many people as possible to encourage local development and improve general living conditions.

This system is adaptable to various regions with different climatic conditions and different needs. In certain areas where there is an adequate water supply for human consumption, this system will store water for irrigation.

In other areas, new industrial and semi-industrial activities, population growth and irregular rainy seasons have meant a decrease in existing water supply; this system may then be used as an additional source of water.

In areas that undergo extended periods of dry weather, this system may be used to collect and store rainwater during the rainy season to provide the local population with adequate water supply for human consumption mainly, but also for domestic use, livestock and/or irrigation purposes.

This invention is also applicable to regions where the existing underground water resources are unreliable or where the existing ground water is contaminated or polluted and available, hence, only for irrigation and livestock.

The system may be divided into three main parts:

A. rainwater catchment,

B. the storage area containing expandable reservoirs and,

C. the outlet or distribution area where the pump(s) is (are) located.

Gravity flow is utilized to channel the collected water from the catchment to the storage reservoirs. The stored water will be withdrawn by means of a pump.

It is contemplated that a number of installations of this system will be carried out in areas lacking natural slopes necessary to obtain a downstream natural gravity flow. In such cases a man-made slope is obtainable by utilizing the soil of an excavated storage area.

The standard design of this system is applicable to each and every installation of the system.

More particularly, the catchment, which is provided for the collection of rainwater, includes a water impervious sheet, the area of the water impervious sheet is selected depending on local annual rainfall. The sheet is supported on a prepared ground surface (preferably sterilized) of generally planar form sloping along a single fall line. The sheet is shaped so that it has at least a portion which may be generally rectangular, and a contiguous portion which is triangular including an apex-like region. The sheet is supported on the prepared surface so that the triangular portion of the sheet is located horizontally below the rectangular portion, with the apex-like region being horizontally below any other region of the triangular portion.

A storage or reservoir includes a prepared depression adjacent to the catchment and particularly the apex-like region thereof. At least one storage tank is located in the depression, each storage tank which is located in the depression comprises a flexible closed container with at least one inlet and one outlet. The depression is located sufficiently horizontally below the apex-like region of the catchment, so that no portion of any storage tank extends horizontally above the apex region even if the tank is storing water at maximum volume. All of the storage tanks are selected in capacity so that the total storage capacity is related to the number of days of continuous dry weather.

A first pipe or the like couples the apex-like region of the catchment to an inlet of each storage tank. At least one pump is provided for evacuating water stored in the reservoir. A second pipe is arranged connecting an outlet of the storage tank(s) to the pump.

Accordingly, the invention provides a system for the collection and storage of potable water comprising:

A. a catchment for the collection of rain water comprising a water impervious sheet of area selected in dependence of local annual rainfall, said sheet is supported on a prepared ground surface (preferably sterilized) of generally planar form sloping along a single fall line, B. said sheet having a portion which is generally rectangular and a contiguous portion which is triangular including an apex-like region, said triangular portion located horizontally below said rectangular portion with said apex-like region being horizontally below any other region of the triangular portion, C. a reservoir including a prepared depression adjacent to the catchment and the apex-like region thereof, at least one storage tank located in said depression, each storage tank located in said depression comprising a flexible closed container with at least one inlet and one outlet, D. said depression located sufficiently horizontally below said apex-like region so that no portion of any storage tank extends horizontally above said apex-like region, even if said tank is storing water at maximum volume, all of said storage tanks selected in capacity so that the total storage capacity is related to the number of days of continuous dry weather, E. first piping means coupling said apex-like region of the catchment and an inlet of each storage tank, F. at least one pump, G. second piping means connecting an outlet of each said tank to said at least one pump.

DETAILED DESCRIPTION

Figure 1:
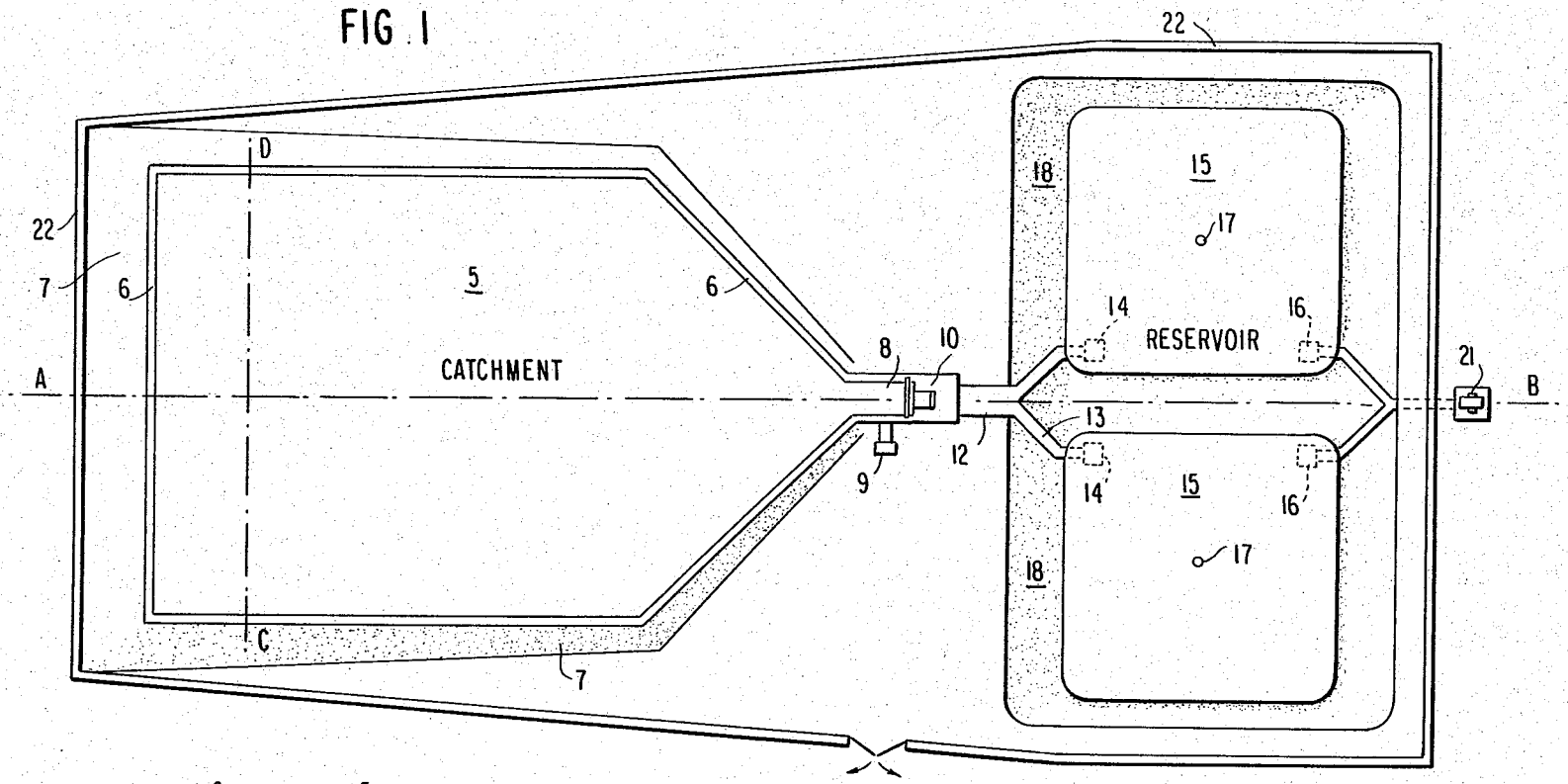
FIG. 1 herein after is a general schematic plan view of a system to harvest rainwater that is safe for human consumption, and storing it for extended periods of time in one or more seal-proof containers or reservoirs of flexible material, with one or more syphons/pumps for water distribution. The use of pumps will ensure a more hygienic access to the stored water eliminating risks of pollution, contamination and waste.
Figure 5:
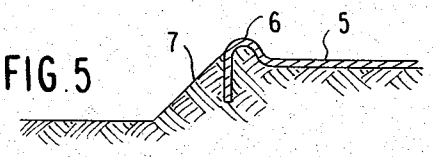
FIG. 5 is a detail of the anchor 6.
Figure 6:
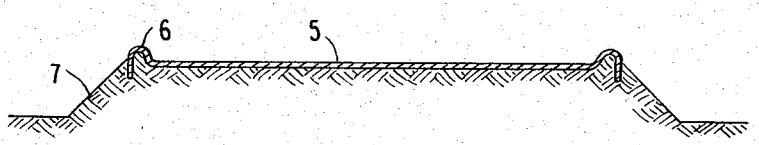
FIG. 6 is a section of the catchment taken on the line C-D of FIG. 1.
Figure 2:
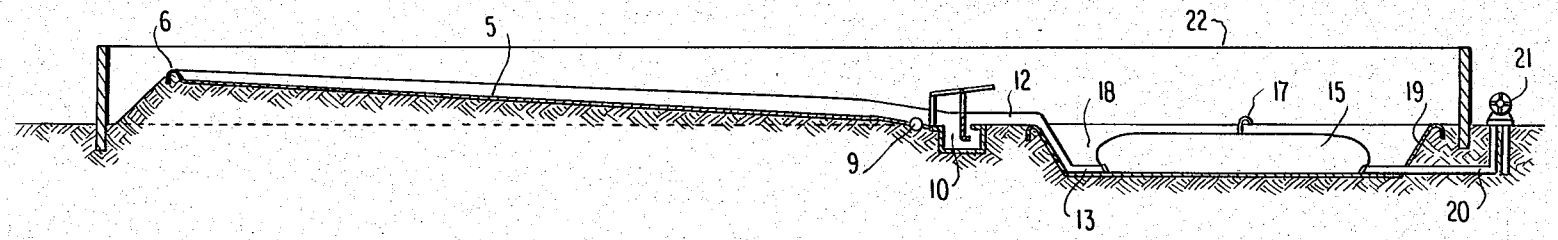
FIG. 2 is a sectional view taken along line A-B.

Referring first to FIG. 1, this figure depicts a rainwater catchment 5 utilizing gravity flow for outlet of the collected water into the storage reservoirs 15; and pumps 21 utilized for outlet of the stored rainwater.

A natural rectified slope of at least 2% will be chosen for the location of the catchment 5. If no natural slope exists, a man-made slope will be obtained by utilizing the earth excavated from the storage area where the reservoirs 15 will be located on a lower level.

The sides of the catchment 5 will be contoured by a raised edge 6 of 0.2 m at the upper part or upstream of catchment 5, and 0.5 m at the lower part and outlet 8 of the catchment 5.

The catchment 5 and the raised edge 6 will be covered by a membrane or sheet made of waterproof, weather and tear resistant material, easily repaired in case of accidental tear or damage. One example of a suitable material is Hypalon available from Water Saver International, Boulder, Colo.

The membrane lining the catchment 5 and the raised edge 6 will be anchored to the ground in a small surrounding trench 7. For this purpose, the membrane lining the catchment 5 and the raised edges 6 will overlap by a margin of no less than 0.75 m and no more that 1.25 m depending on local conditions (winds, etc.) This margin will line the anchoring trench and be adequately covered with soil and compacted to ensure best anchoring results.

Figure 4:
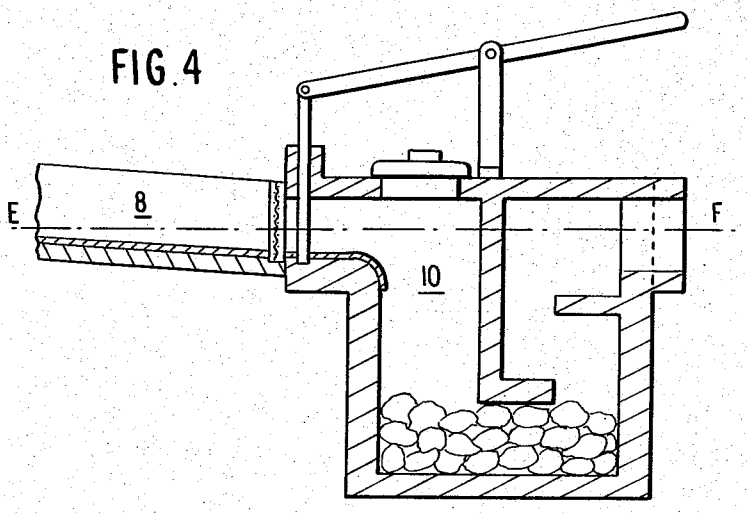
FIG. 4 is a sectional view of the screening and decanting filter 10 taken along line G-H.
Figure 3:
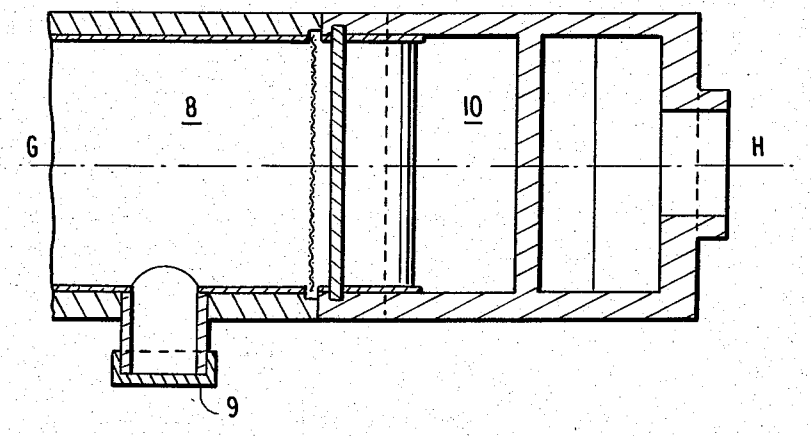
FIG. 3 is a plan view showing a screening and decanting filter 10.

The water collected from the first rain will serve to rinse the catchment 5 and will be channelled through a bypass 9 to an evacuation ditch (not illustrated). This will be obtained by closing the main screening and decanting filter 10 by operating the valve shown in FIG. 4.

After the first rains, the main screening and decanting filter 10, will be opened to let water flow through the pipes 12 into the storage reservoirs 15.

The main pipe 12 is connected to a flexible hose 13 which is directly hooked to the reservoir by a clamp (not illustrated).

The access fitting for inlet 14 and the access fitting for outlet 16 of the reservoirs 15 will be located at the bottom of the reservoir at each end.

The storage area 18 containing the reservoirs 15 will be located on a lower level but close to the catchment 5. The difference in level will avoid any backwatering. To avoid backwatering the upper part of the filled reservoirs will not be higher then the level of the main pipe 12 connected to the catchment 5.

If and where additional irrigation water is needed, the storage area 18 is lined with a protective waterproof, flexible wear and tear resistant membrane 19 for two main reasons:

A. the additional untreated rainwater accumulated in that area throughout the rainy season may be used for livestock, domestic use or irrigation; and B. protect the reservoirs from ground defects, roots, rocks, brush, sods, clods and rodents that might in anyway endanger the reservoirs 15.

The reservoirs 15 will be manufactured in a resistant but flexible material easy to fold, unfold and transport as well as easily repaired in case of accidental damage. One example of a suitable tank is Pillow Tanks offered by Goodyear, Inc. Suitable flexible tanks are also available from Uniroyal.

An air vent 17 on top of the reservoir will avoid any counterpressure due to air compressed by incoming collected water and/or vapor formation.

The water stored in the reservoirs 15 will be drawn by pumps 21. These can be hand pumps or pumps powered by some other form of energy.

The pumps 21 will be connected to the reservoir outlet access fittings 16 by an underground PVC pipe 20 or the like.

An enclosure 22 around the rainwater catchment 5 and the storage area 17 will protect the installation from children and animals (domestic or wild) that might pollute or damage the system in any way.

The pumps 21 will be the only elements outside of the enclosure 22.

This enclosure 22 of about 2 meters high will be manufactured with material found locally (such as wood, bricks, etc.) or brought in for that purpose (wires, bricks, etc.) on the consumers' initiative.

The PVC pipe 20 connecting the pumps or pump 21 to the reservoirs' outlet fittings 16 may be in the form of a Y. The pump 21 will be placed at equal distance from both reservoirs. If more than one pump were to be used, these pumps would be interconnected by a further "Y" fitting.

For sizing purposes let

P=Surface area of the catchment 5

RC=Required Reservoir Capacity (liters) 15

Variable data:

U=Number of users

D=Number of days of continuous dry weather

R=Annual rainfall (in mm)

C=Daily individual minimum consumption (in liters)

S=Equivalent side of catchment (in m)

Required Reservoir Capacity $$RC=D\times U\times C$$

Catchment Plane Surface $$P=RC/R$$

Total Surface of Required Lining Membrane $$\sqrt{P}=S \text{ (at least approximately)}$$

$$S\times 4=\text{Perimeter of the catchment Pp}$$

The Surface of the Anchoring Edge $$E=(S\times 4)m\times 0.75 \text{ minimum}$$

or $$E=(S\times 4)m\times 1.25 \text{ maximum}$$

In the preceding description it should be apparent that the components required to implement this system comprise essentially only:

1. a water impervious membrane or sheet for forming the catchment;
2. one or more flexible storage tanks;
3. at least one pump, and perhaps more than one pump;
4. a suitable strainer; and,
5. incidental piping and couplers.

Of these components the flexible storage tanks are by far the most expensive although because of their nature they as well as the sheet or membrane are easily transportable. That is a suitable flexible storage tank which has a capacity on the order of 50,000 gallons can, once folded, be easily moved by a single person.

The only required installation operation is the preparation of the prepared surface for the catchment and an excavation (or the location of a suitable depression) for receipt of the storage tanks. As suggested above, if a suitable region of appropriate slope is not available, the soil excavated can be used to provide the appropriate slope. Once the catchment and reservoir areas have been prepared, the membrane or sheet is laid over the catchment and secured along its edges as described. The storage tanks are located in the appropriate region, a pipe is coupled between the apex-like region of the catchment to a strainer, the outlet of which is coupled to one or more storage tanks. The outlet of the storage tanks can be coupled together via additional piping, and perhaps run through an underground conduit to the inlet of an hand-driven pump or a pump powered by some other form of energy. Once this assembly is completed it is only necessary to provide for the suitable enclosure which can be readily provided by unskilled labor with available materials.

In one embodiment of the invention which has been designed for a village of 300 people in Dori, Upper Volta, Africa, where the annual rainfall is estimated to be 500 mm, and there are 240 continuous days of dry weather, the total cost of providing a year-round water supply (for materials) for 10–15 years is $55,000. This is significantly less costly than prior art techniques.

What is claimed is:

1. A system for the collection and storage of potable water comprising:

(a) a catchment for the collection of rainwater comprising a water impervious sheet of area selected in dependence on local annual rainfall, said sheet supported on a prepared ground surface of generally planar form sloping along a single fall line, (b) said sheet having a portion which is generally rectangular and a contiguous portion which is generally triangular including an apex-like region, said generally triangular portion located horizontally below said rectangular portion with said apex-like region being horizontally below any other region of the generally triangular portion, (c) a reservoir including a prepared depression adjacent to the catchment and the apex-like region thereof, at least one storage tank located in said depression, each storage tank located in said depression comprising a flexible closed container with at least one inlet and one outlet, (d) said depression located sufficiently horizontally below said apex-like region so that no portion of any storage tank extends horizontally above said apex region, even if said tank is storing water at maximum volume, all of said storage tanks selected in capacity so that the total storage capacity is related to the number of days of continuous dry weather and the number of consumers, (e) first piping means coupling said apex-like region of the catchment and an inlet of each storage tank, (f) at least one pump, (g) second piping means connecting an outlet of each said tank to said at least one pump.

2. The system of claim 1 in which said first piping means includes means for straining water flowing between said catchment and said tank.

3. The system of claim 2 in which said means for straining includes an inlet and an outlet substantially located in a common horizontal plane and a baffle preventing any direct flow path between said inlet and outlet.

4. The system of claim 2 in which said means for straining includes a switchable outlet to selectively couple said catchment to said tank or to an evacuation ditch.

5. The system of claim 3 in which said means for straining includes a switchable outlet to selectively couple said catchment to said tank to an evacuation ditch.

6. The system of claim 1 in which each tank includes an air vent located in an upper surface of the tank.

7. The system of claim 1 further including a second water impervious sheet lining said depression.

* * * * *